US006509698B1

(12) United States Patent
Kominami et al.

(10) Patent No.: US 6,509,698 B1
(45) Date of Patent: Jan. 21, 2003

(54) OPERATING APPARATUS OF DISCHARGE LAMP

(75) Inventors: Satoshi Kominami, Osaka (JP); Kenichiro Takahashi, Osaka (JP); Koji Miyazaki, Osaka (JP); Mamoru Takeda, Kyoto (JP); Masayoshi Gyoten, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/686,999

(22) Filed: Oct. 12, 2000

(30) Foreign Application Priority Data

Mar. 27, 2000 (JP) ..... 2000-086115

(51) Int. Cl.[7] ..... H05B 37/02
(52) U.S. Cl. ..... 315/291; 315/308
(58) Field of Search ..... 315/307, 291, 315/224, 225, 244, 209 R, 308, 241 R

(56) References Cited

U.S. PATENT DOCUMENTS 4,734,624 A * 3/1988 Nagase et al. ..... 315/209 R
5,636,111 A * 6/1997 Griffin et al. ..... 315/225
5,717,295 A * 2/1998 Nerone ..... 315/224
5,729,096 A * 3/1998 Liu et al. ..... 315/307
5,828,187 A * 10/1998 Fischer ..... 315/291

FOREIGN PATENT DOCUMENTS

| | | |
|---|---|---|
| JP | 10-501651 | 2/1998 |
| JP | 11-111486 | 4/1999 |
| JP | 2001-313196 | 11/2001 |
| WO | WO 96/31096 | 10/1996 |

OTHER PUBLICATIONS

Notice of Reasons of Rejection, Patent Application No. 2000–086115 Mailing Date: Feb. 5, 2002, Mailing No. 033289.

* cited by examiner

*Primary Examiner*—Don Wong
*Assistant Examiner*—Wilson Lee
(74) *Attorney, Agent, or Firm*—Nixon Peabody LLP; Thomas W. Cole

(57) ABSTRACT

The present invention discloses an operating apparatus of discharge lamp comprising an AC/DC converter means for converting an ac voltage into a dc voltage, a DC/AC converter means for converting a dc output voltage of the AC/DC converter means into a high frequency ac voltage, a discharge lamp coupled to an output terminal of the DC/AC converter means, and a controller means by which the output of the DC/AC converter means is made variable according to an integrated value based on a half cycle of the ac voltage.

6 Claims, 9 Drawing Sheets

OPERATING APPARATUS OF DISCHARGE LAMP

BACKGROUND OF THE INVENTION

The present invention relates to an operating apparatus of discharge lamp. More particularly, the present invention relates to an operating apparatus of discharge lamp which is fed a phase-controlled alternating current (ac) voltage to adjustably control (dim) the brightness of a discharge lamp (e.g., a fluorescent lamp).

Advantages of fluorescent lamps over incandescent lamps are their higher efficiency and longer life span. Accordingly, various fluorescent lamps have been extensively used as luminaires suitable for household use. Particularly, the compact self-ballasted fluorescent lamp is replaceable directly with a conventional incandescent lamp. Because of this, the compact self-ballasted fluorescent lamp has lately attracted attention and has been now used widely. Recently, there has been a demand for adjustably controlling the brightness of fluorescent lamps in the same way as incandescent lamps. To meet this need, dimmable fluorescent lamps also have been developed.

In a typical technique of accomplishing dimming of the incandescent lamp, a phase-controlled ac voltage is input for incandescent lamp dimming. On the other hand, compact self-ballasted fluorescent lamp dimming requires the provision of a ballast circuit. The ballast circuit is fed a phase-controlled ac voltage to accomplish fluorescent lamp dimming. One example of an operating apparatus of discharge lamp of the type which is fed a phase-controlled ac voltage to accomplish fluorescent lamp dimming, is shown in JP Kokai Publication No. H11-111486.

Such a published operating apparatus of discharge lamp has a sensor means for detecting the conduction period of a phase-controlled ac voltage to be input and an inverter ballast circuit capable of variable output, wherein the output of the inverter ballast circuit is controlled according to the signal from the sensor means so as to vary the brightness of the fluorescent lamp. The sensor means provides a pulse signal proportional to the conduction period. If the conduction period is long, then the inverter ballast circuit will give an increased output to increase the brightness of the fluorescent lamp. On the other hand, if the conduction period is short, then the inverter ballast circuit will give a decreased output to decrease the brightness of the fluorescent lamp.

However, a conventional operating apparatus of discharge lamp of the type described above is constructed to control the light output of a fluorescent lamp according to a length of the conduction period of the input phase-controlled ac voltage. Accordingly, the light output varies substantially linearly with respect to the conduction period (FIG. 8). On the other hand, when a phase-controlled ac voltage is fed to an incandescent lamp, the light output varies non-linearly with respect to the conduction period (FIG. 9). The reason for such non-linear light output variation is that an effective value of the voltage that is fed to an incandescent lamp varies with respect to the conduction period as shown in FIG. 10.

Accordingly, when an operating apparatus of discharge lamp of the above-described conventional type is applied to compact self-ballasted fluorescent lamps, the light output with respect to the conduction period varies differently from the incandescent lamp. This may often cause a user to feel something incongruent for such light output.

Bearing in mind the above problem, the present invention was made. Accordingly, an major object of the present invention is to provide an operating apparatus of discharge lamp capable of accomplishing the discharge lamp dimming much similar in light output variation to incandescent lamp dimming.

SUMMARY OF THE INVENTION

The present invention provides an operating apparatus of discharge lamp comprising (a) AC/DC converter means for converting an ac voltage into a dc voltage, (b) DC/AC converter means for converting a dc output voltage of the AC/DC converter means into a high frequency ac voltage, (c) a discharge lamp coupled to an output terminal of the DC/AC converter means, and (d) controller means by which the output of the DC/AC converter means is made variable according to an integrated value of the ac voltage based on a half cycle thereof.

In an embodiment of the present invention, the controller means has an arithmetic part for performing arithmetic operations to calculate from the integrated value an approximate average value in one cycle and a control part by which the output of the DC/AC converter means is made variable according to an output signal level of the arithmetic part.

Preferably, the controller means further has characteristic detector means for detecting a lamp characteristic of the discharge lamp.

Preferably, the characteristic detector means detects at least one of a lamp voltage, lamp current, lamp power, and light output as the lamp characteristic.

In an embodiment of the present invention, the controller means has a function of causing the output frequency of the DC/AC converter means to vary.

In an embodiment of the present invention, the operating apparatus of discharge lamp is a compact self-ballasted fluorescent lamp with a base in which a ballast circuit including at least the AC/DC converter means, the DC/AC converter means, and the controller means and the discharge lamp are integrally formed.

DESCRIPTION OF PREFERRED EMBODIMENTS

An operating apparatus of discharge lamp in accordance with the present invention has a controller means by which the output of a DC/AC converter means is made variable according to an integrated value of the input ac voltage based on a half cycle thereof. Therefore, the light output can be varied non-linearly. As a result, it is possible to accomplish dimming similar to incandescent lamp dimming. Hereinafter, embodiments of the present invention will be described by making reference to the drawings. The present invention is not limited to these embodiments.

EMBODIMENT 1

Figure 1:
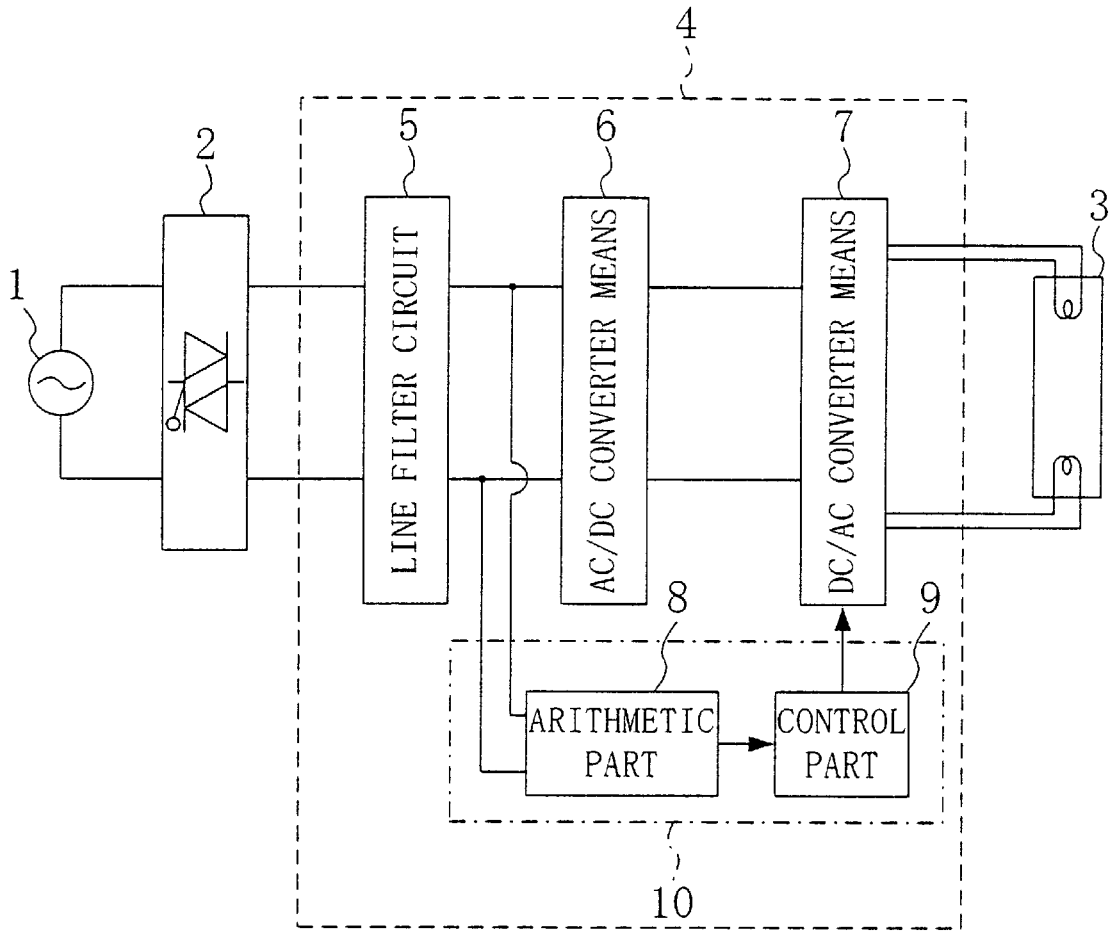
FIG. 1 is a construction diagram of an operating apparatus of discharge lamp in accordance with a first embodiment of the present invention.

Referring to from FIG. 1 to FIG. 6, an operating apparatus of discharge lamp in accordance with a first embodiment of the present invention will be explained. FIG. 1 shows a construction of the operating apparatus of discharge lamp of the first embodiment.

The operating apparatus of discharge lamp of the present embodiment comprises an AC/DC converter means 6 for converting an ac voltage into a direct current (dc) voltage, a DC/AC converter means 7 for converting a dc output voltage of the AC/DC converter means 6 into a high frequency ac voltage, a discharge lamp 3 connected to an output terminal of the DC/AC converter means 7, and a controller means 10 by which the output of the DC/AC converter means 7 is made variable according to an integrated value of the ac voltage based on a half cycle thereof. In the present embodiment, the AC/DC converter means 6 is coupled, through a line filter circuit 5 and a phase controller means 2, to an ac power supply 1 which supplies an ac voltage. In the present embodiment, a group, comprised of the line filter circuit 5, a group of the AC/DC converter means 6, the DC/AC converter means 7, and the controller means 10, is called a ballast circuit 4.

The ac power supply 1 is, for example, a 60 Hz/100V power supply and the phase controller means 2 is disposed for phase control of the ac power supply 1. The phase controller means 2 is implemented by a device such as a triac known in the art. The discharge lamp 3, coupled to the ballast circuit 4, is a fluorescent lamp and the ballast circuit 4 supplies electric power to the fluorescent lamp 3 to turn on the fluorescent lamp 3. The AC/DC converter means 6, included in the ballast circuit 4 of the present embodiment, converts a phase-controlled ac voltage from the phase controller means 2 into a dc voltage and the DC/AC converter means 7 converts a dc output voltage from the AC/DC converter means 6 into a high frequency ac voltage of, for example, 50 kHz. Further, the controller means 10 makes the output of the DC/AC converter means 7 variable according to an integrated value of the phase-controlled ac voltage from the phase controller means 2 based on a half cycle thereof, thereby controlling the brightness of the fluorescent lamp 3. The controller means 10 has an arithmetic part 8 for performing arithmetic operations to calculate, from the foregoing integrated value, an approximate average value in one cycle and a control part 9 by which the output of the DC/AC converter means 7 is made variable according to an output signal level of the arithmetic part 8.

The line filter circuit 5 is comprised of components including an inductance element and a capacitor. The line filter circuit 5 is disposed to inhibit high frequency noise from escaping to the ac power supply 1. The ballast circuit 4 can be constructed without the provision of the line filter circuit 5. The AC/DC converter means 6, comprised of components including a rectifier circuit and a smoothing capacitor, is disposed to rectify and smooth a phase-controlled ac voltage that is fed through the line filter circuit 5, for conversion into a dc voltage.

Figure 2:
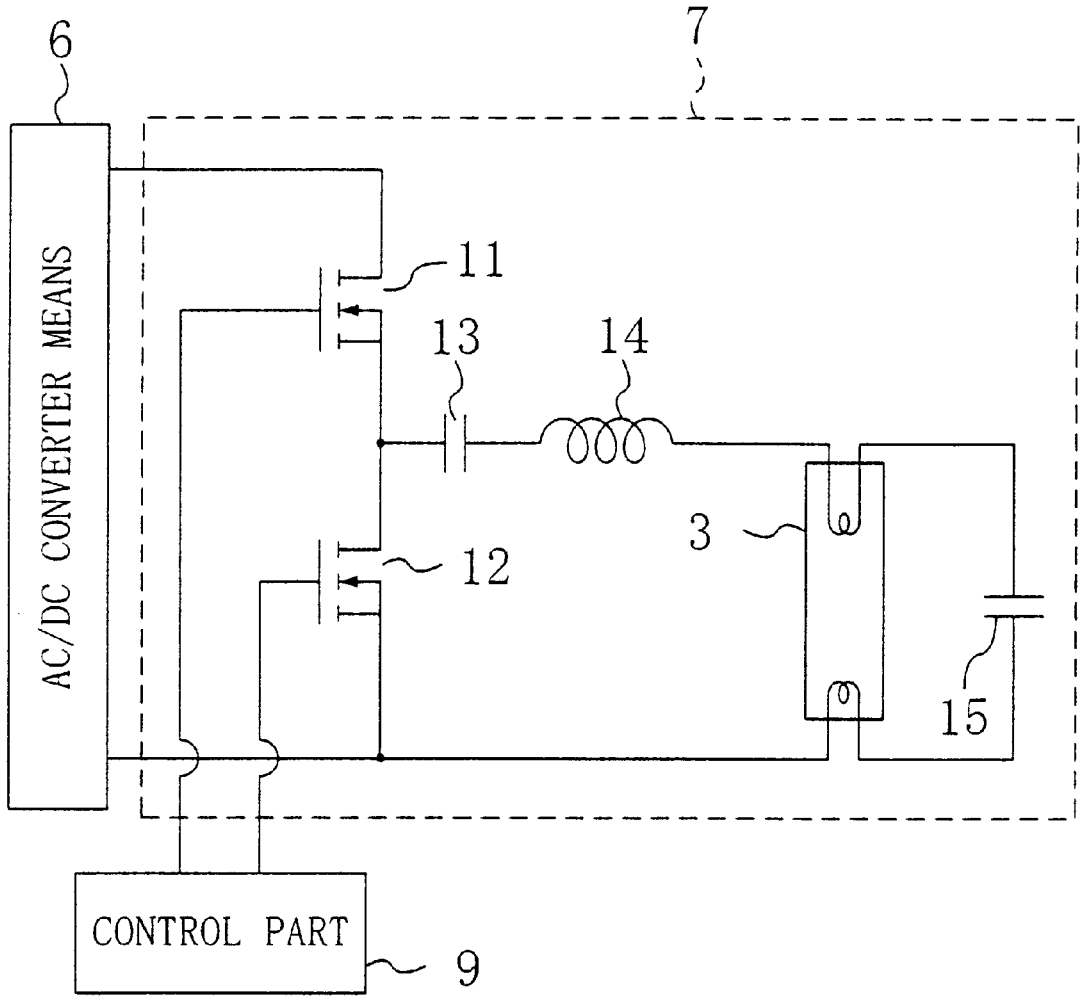
FIG. 2 is a construction diagram of an example of a DC/AC converter means 7.

Reference is now made to FIG. 2 which shows an example of the construction of the DC/AC converter means 7. The DC/AC converter means 7 of FIG. 2 has switching elements 11 and 12 both of which are coupled to the AC/DC converter means 6, a capacitor 13 for dc component cut, a choke coil 14 for restricting a lamp current flowing in the fluorescent lamp 3, and a capacitor 15 for preheating the electrodes of the fluorescent lamp 3 and for generating a resonance voltage at each end of the fluorescent lamp 3.

The switching elements 11 and 12 are alternately turned on and off on the basis of the signal from the control part 9 and the DC/AC converter means 7 converts a dc output voltage from the AC/DC converter means 6 into a high frequency ac voltage, thereby to supply electric power to the fluorescent lamp 3 through a resonance circuit made up of the choke coil 14 and the capacitor 15. Electric power that is supplied to the fluorescent lamp 3 is dependent on the switching frequency of the switching elements 11 and 12. Therefore, when the switching frequency is low, relatively high power is supplied to the fluorescent lamp 3. On the other hand, when the switching frequency is high, relatively low power is supplied to the fluorescent lamp 3. The reason for this is that the impedance of the lamp current restriction choke coil 14 varies in accordance with the switching frequency.

Figure 3:
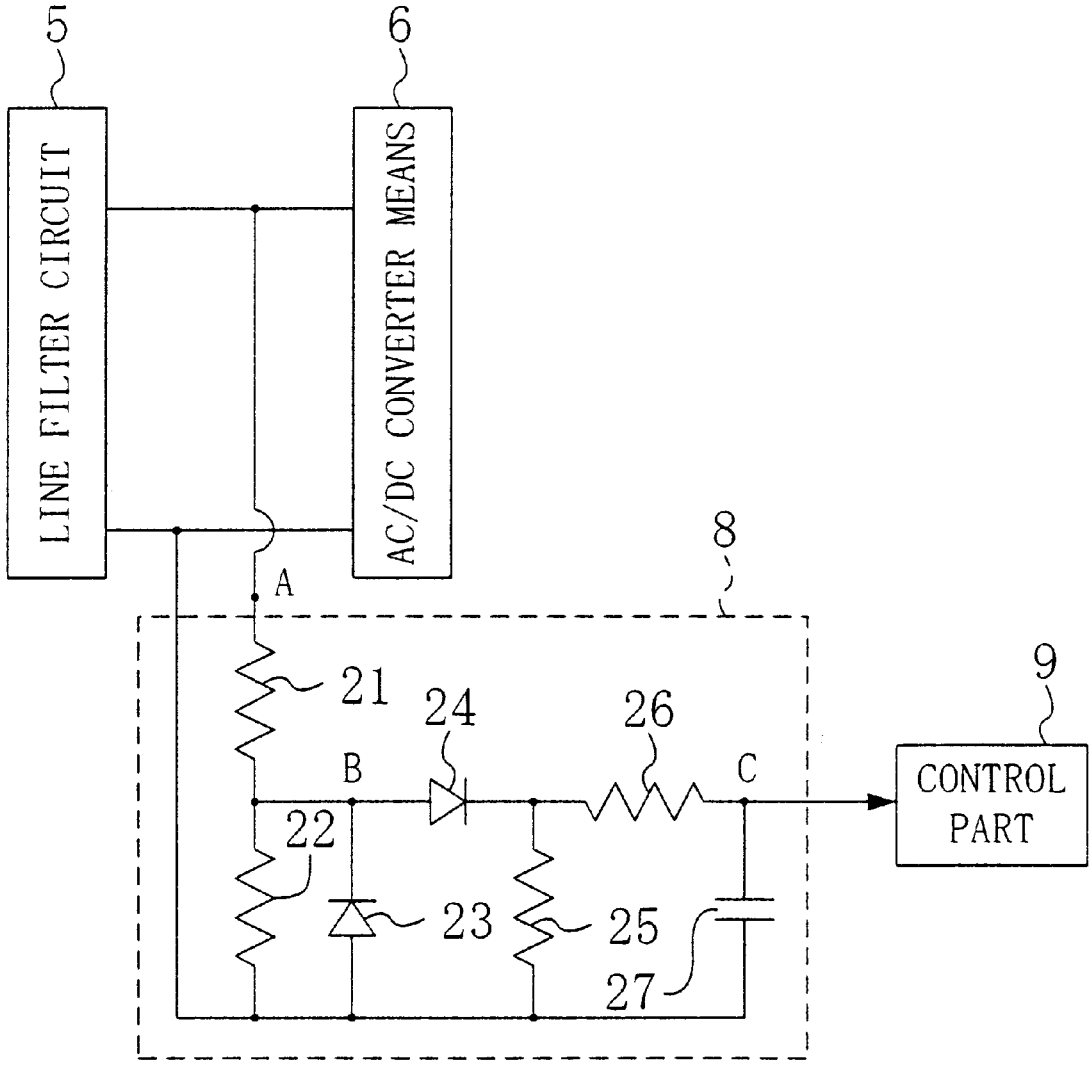
FIG. 3 is a construction diagram of an example of an arithmetic part 8.
Figure 4A:
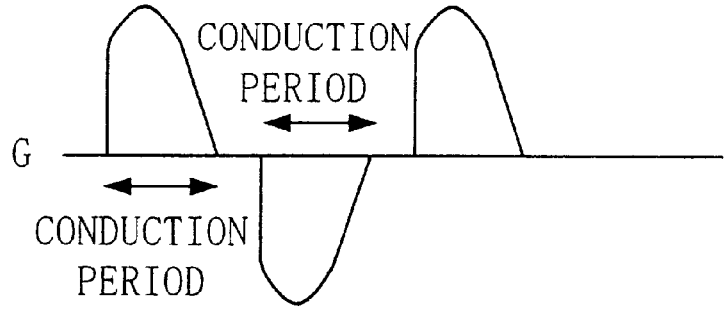
FIGS. 4A–4C are waveform charts of individual points in the arithmetic part 8.
Figure 4B:
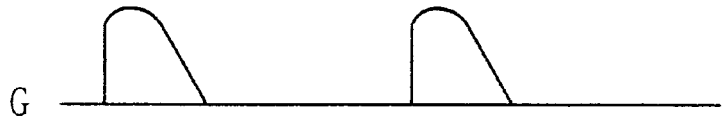
Figure 4C:
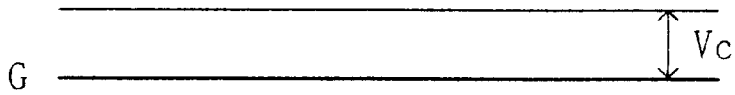

FIG. 3 shows an example of the construction of the arithmetic part 8. The arithmetic part 8 of FIG. 3 is comprised of resistors 21, 22, 25, and 26, diodes 23 and 24, and a capacitor 27. The arithmetic part 8 is disposed for performing arithmetic operations to calculate the half-cycle average value of a phase-controlled ac voltage. FIGS. 4A–4C depict voltage waveforms at points A, B, and C of FIG. 3, respectively.

The operation of the arithmetic part 8 will be described with reference to FIGS. 3 and 4. FIG. 4A depicts a signal which is fed into the arithmetic part 8. The signal of FIG. 4A is voltage divided by the resistors 21 and 22 and rectified by the diode 23. Then, the signal becomes such a signal as shown in FIG. 4B at the point B of FIG. 3. The signal is passed through the diode 24 and is integrated in the resistor 26 and the capacitor 27. The resulting signal at the point C of FIG. 3 is depicted in FIG. 4C. The signal of the point C is the average value of the signal of FIG. 4B and is equivalent to an approximate average value in one cycle calculated by the arithmetic part 8 from an integrated value of the phase-controlled ac voltage based on a half cycle thereof. The signal of the point C is sent to the control part 9.

Figure 5:
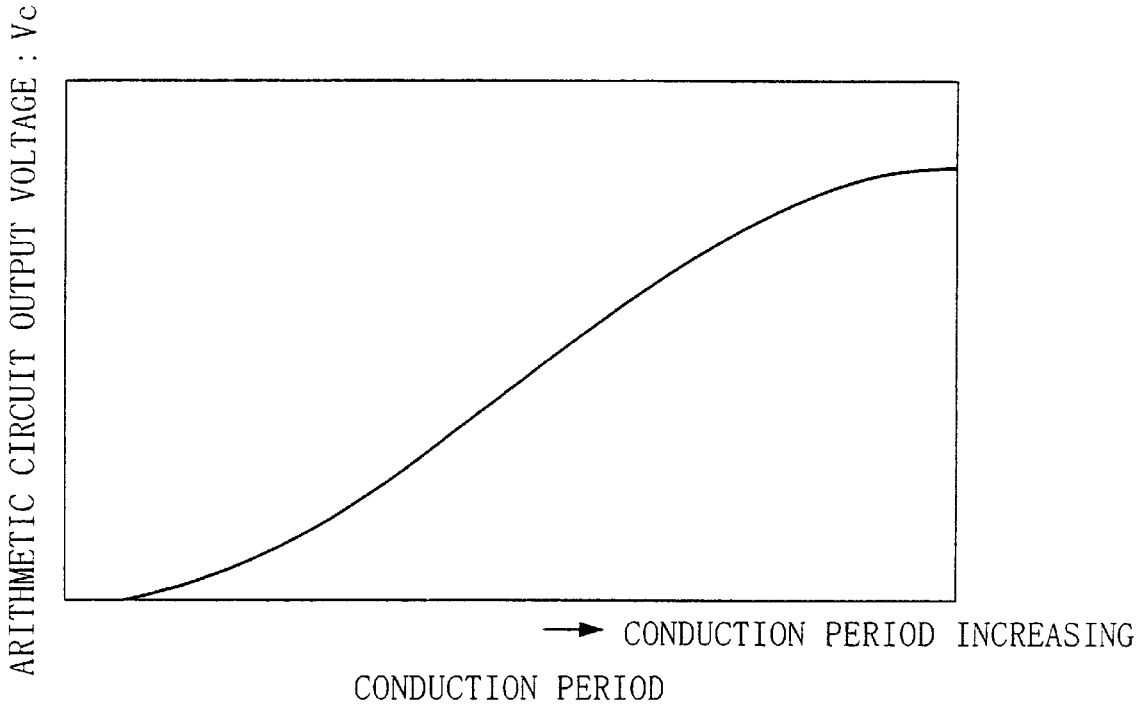
FIG. 5 graphically represents the output voltage of the arithmetic part 8 with respect to the conduction period.

The conduction period of the phase-controlled ac voltage can be set by a user to any arbitrary value with the phase controller means 2, so that the signal level, Vc, at the point C of FIG. 4C varies with respect to the conduction period as shown in FIG. 5. That is, longer conduction period results in higher voltage. On the other hand, shorter conduction period results in lower voltage. The resistor 25 of FIG. 3 is disposed to discharge electric charges that have been stored in the capacitor 27.

The control part 9, coupled to the arithmetic part 8, controls the switching frequency of the switching elements included in the DC/AC converter means 7 according to the signal from the arithmetic part 8, thereby controlling the light output of the fluorescent lamp 3. The control part 9 can be implemented by, for example, an inverter IC.

Figure 6:
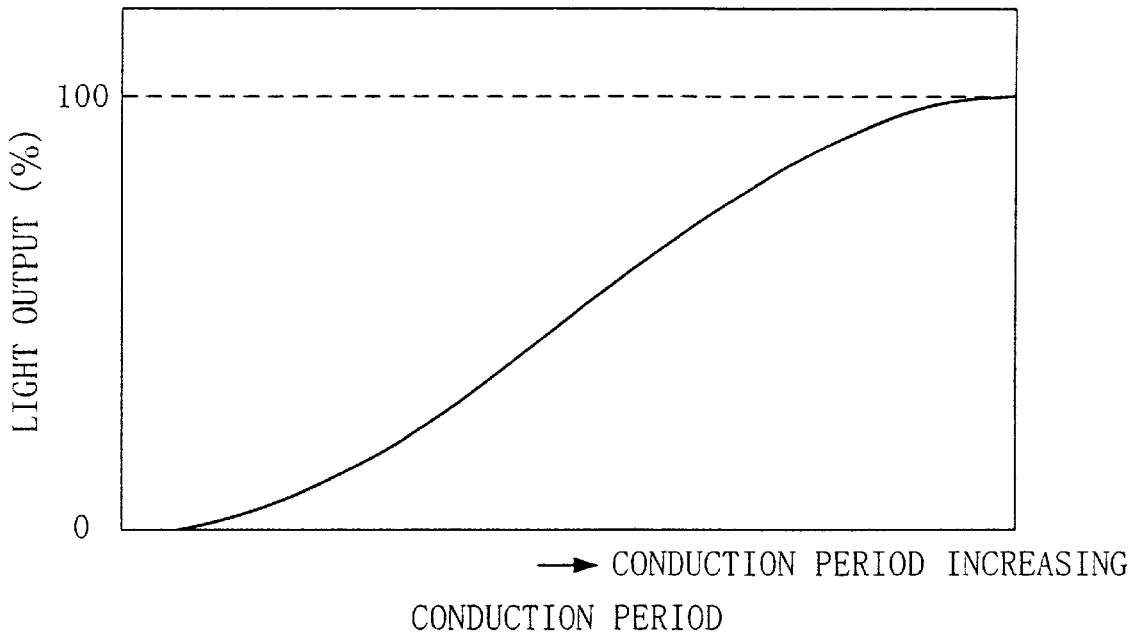
FIG. 6 graphically represents the light output with respect to the conduction period in the first embodiment construction.
Figure 9:
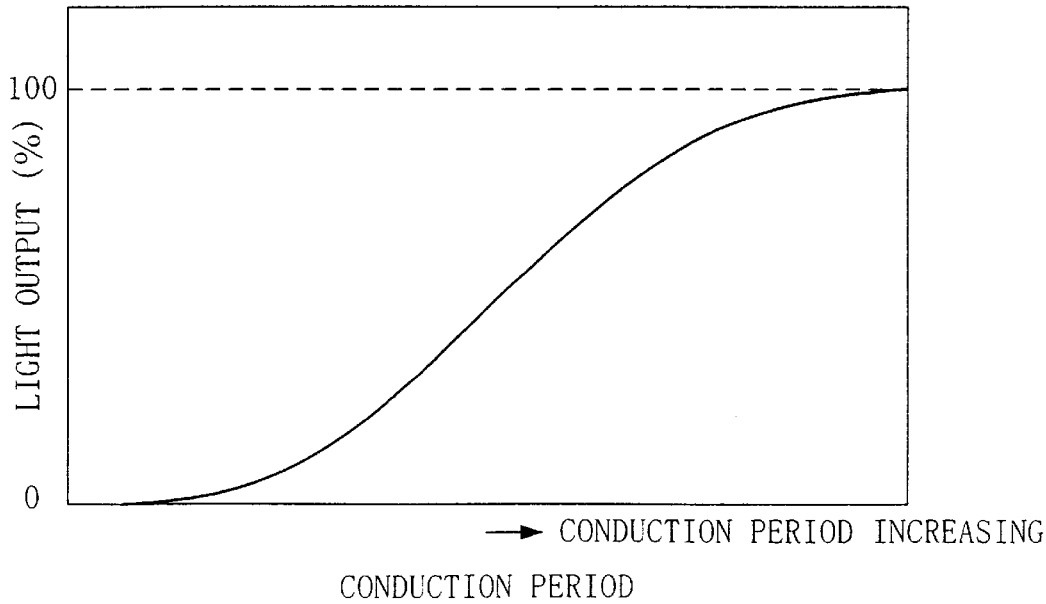
FIG. 9 graphically represents the light output with respect to the conduction period in an incandescent lamp.
Figure 10:
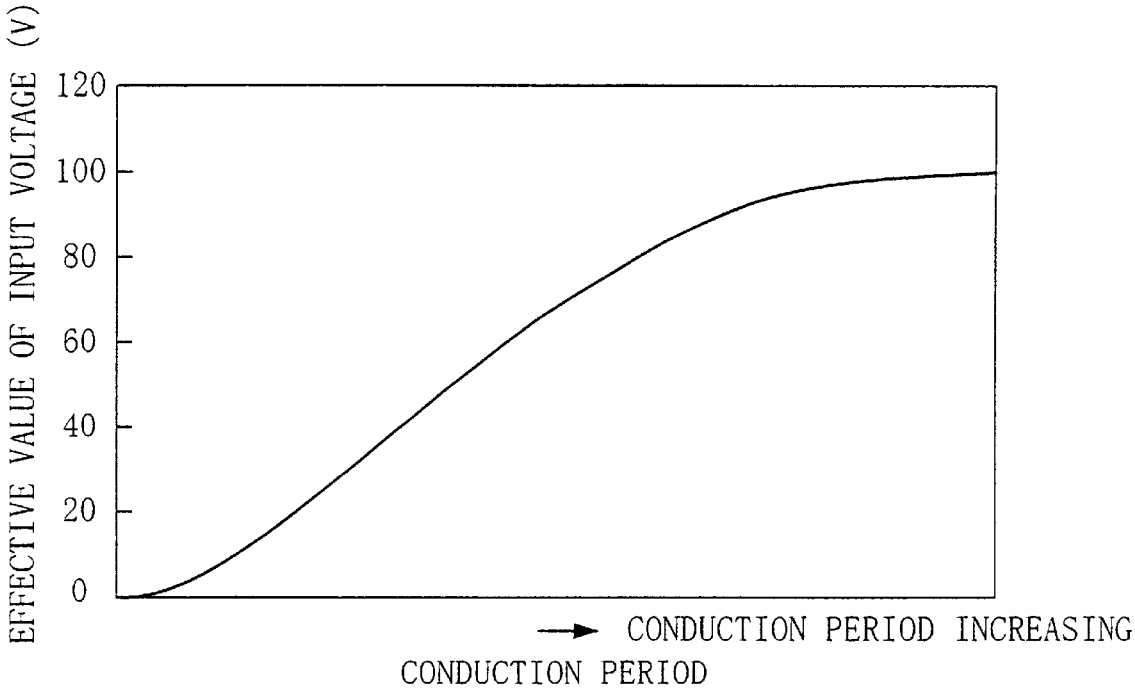
FIG. 10 graphically represent effective values of an input voltage with respect to the conduction period in an incandescent lamp.

Next, the operation of the operating apparatus of discharge lamp having the above-described construction will be explained. The fluorescent lamp 3 maintains its on state by a supply of high frequency electric power from the DC/AC converter means 7. If the signal from the arithmetic part 8 is low, then the control part 9 controls the DC/AC converter means 7 to supply low electric power to the fluorescent lamp 3. On the other hand, if the signal from the arithmetic part 8 is high, then the control part 9 controls the DC/AC converter means 7 to supply high electric power to the fluorescent lamp 3. At this time, the signal of the arithmetic part 8 varies according to the conduction period set by the phase controller means 2 as shown in FIG. 5, so that the light output of the fluorescent lamp 3 varies with respect to the conduction period as shown in FIG. 6. As can be seen from FIGS. 6 and 9, the variation in light output with respect to the conduction period (FIG. 6) becomes similar to that in the incandescent lamp (FIG. 9).

In accordance with the present embodiment, the following are provided, namely, the AC/DC converter means 6 for converting a phase-control ac voltage into a dc voltage, the DC/AC converter means 7 for converting a dc output voltage from the AC/DC converter means 6 into a high frequency ac voltage, the arithmetic part 8 for calculating the half-cycle average value of a phase-controlled ac voltage, and the control part 9 for controlling the switching frequency of the DC/AC converter means 7 according to the output signal from the arithmetic part 8 thereby to control the light output of the fluorescent lamp 3. The switching frequency of the DC/AC converter means 7 is controlled according to the signal corresponding to the average value of the phase-controlled ac voltage calculated by the arithmetic part 8, which makes it possible to control the light output of the fluorescent lamp 3. Accordingly, the variation in light output with the conduction period can be made much similar to that in the incandescent lamp.

To sum up, the conventional techniques employ such a construction that the light output of a fluorescent lamp is controlled according to the conduction period of an input phase-controlled voltage. This construction causes the light output to vary substantially linearly with respect to the conduction period. Accordingly, it is likely for a user to feel something incongruent. On the other hand, in the ballast circuit device of the present embodiment, the light output of the fluorescent lamp 3 is controlled by the controller means 10 (the arithmetic part 8 and the control part 9) by which the output of the DC/AC converter means is made variable according to an integrated value of the ac voltage based on a half cycle thereof, as a result of which arrangement the light output with respect to the conduction period can be varied non-linearly. This makes it possible to reduce the degree of incongruity that the user may feel.

Further, in the present embodiment, the control part 9 is provided with a detector means (a character detector means) for detection of lamp characteristics of the fluorescent lamp 3. The signal of the characteristic detector means is compared with a signal from the arithmetic part 8 serving as a reference signal and the switching frequency of the switching elements included in the DC/AC converter means 7 is so controlled as to reduce the error, for accomplishing more stable lighting of the fluorescent lamp 3. That is, even when there exists a variation in the characteristic of the fluorescent lamp 3, it is possible to accomplish stable lighting of the fluorescent lamp 3 by correction made by the characteristic detector means capable of detecting the lamp characteristic of the fluorescent lamp 3. For example, when the brightness of the fluorescent lamp 3 is greater than the set reference, the characteristic detector means performs such control as to increase the switching frequency. On the other hand, when the brightness of the fluorescent lamp 3 is lower than the set reference, the characteristic detector means performs such control as to decrease the switching frequency.

As the lamp characteristic that is detected by the characteristic detector means, lamp characteristics including lamp voltage, lamp current, lamp power, and light output can be used. For the case of lamp voltage detection, for example, resistors are connected to both of the ends of the fluorescent lamp 3 for resistor voltage division thereby to obtain a signal proportional to the lamp voltage. For the case of lamp current detection, for example, a detection resistor is connected serially to the fluorescent lamp 3 thereby to obtain a signal proportional to the lamp current. For the case of lamp power detection, for example, a lamp voltage and a lamp current are detected in the way as described above and the resulting signals are multiplied thereby to obtain a signal proportional to the lamp power. For the case of light output detection, for example, a phototransistor/photodiode or the like is disposed in the vicinity of the fluorescent lamp 3 and a light signal is converted to an electrical signal thereby to obtain a signal proportional to the light output. Such a construction can be implemented by forming a feedback circuit by the use of an OP amplifier.

EMBODIMENT 2

Figure 7:
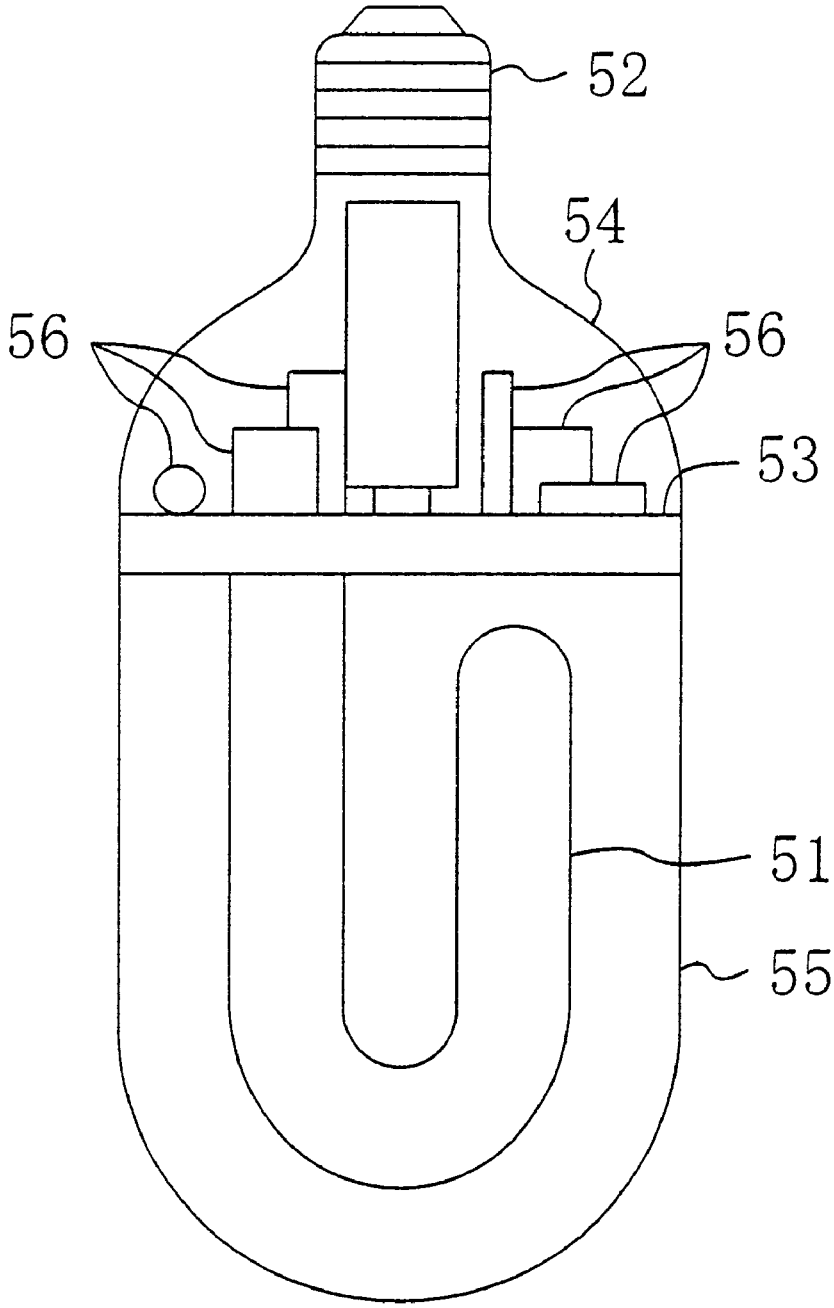
FIG. 7 is a diagram schematically showing a compact self-ballasted fluorescent lamp in accordance with a second embodiment of the present invention.
Figure 8:
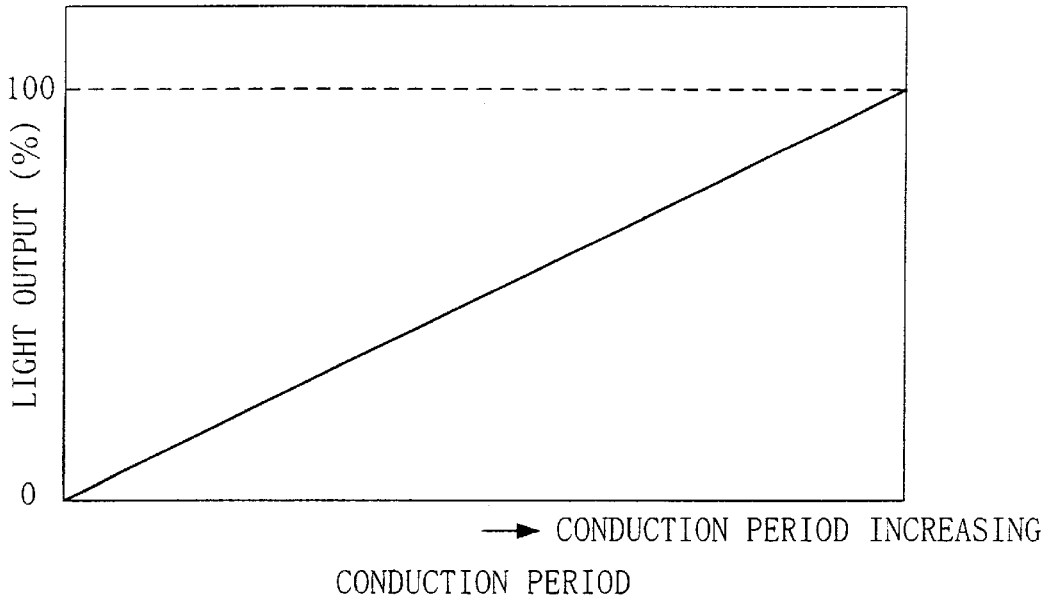
FIG. 8 graphically represents the light output with respect to the conduction period in a prior art technique.

An operating apparatus of discharge lamp according to a second embodiment of the present invention will be described by making reference to FIG. 7. FIG. 7 schematically shows a construction of the operating apparatus of discharge lamp of the present embodiment.

The operating apparatus of discharge lamp of the present embodiment is a compact self-ballasted fluorescent lamp. The operating apparatus of discharge lamp of FIG. 7 (the compact self-ballasted fluorescent lamp) has a fluorescent lamp 51 as a discharge lamp having a curved shape, a base 52 such as an incandescent lamp E26 type base, a circuit board 53 with wiring formation of the construction of the ballast circuit 4 of the first embodiment onto which circuit components 56 are attached, a cover 54 attached, at its one end, to the base 52 and housing therein the circuit board 53, and a translucent globe 55 arranged so as to enclose the fluorescent lamp 51. Although not shown in the figure, the fluorescent lamp 51 and the circuit board 53, and the circuit board 53 and the base 52 are electrically connected together, and when the operating apparatus of discharge lamp is screwed, through the base. 52, into a socket for incandescent lamps, the fluorescent lamp 51 is fed electric power to turn on. The ac voltage that is fed through the base 52 to the lighting device is an ac voltage phase-controlled by an external phase control device (such as a dimmer for incandescent lamps).

Although the circuit components 56 constituting the ballast circuit 4 are attached to the circuit board 53, only typical components of them are shown in FIG. 7. Since the fluorescent lamp lighting device of the present embodiment has the circuit board 53 on which the ballast circuit 4 of the first embodiment is formed, this makes it possible to input a phase-controlled ac voltage for adjustably controlling the brightness of the fluorescent lamp 51, as in the first embodiment. In other words, by virtue of the ballast circuit 4 in the circuit board 53, the light output is varied non-linearly, whereby fluorescent lamp dimming similar to that in the incandescent lamp can be accomplished.

The compact self-ballasted fluorescent lamp of the present embodiment comprises the base 52, the fluorescent lamp 51, the circuit board 53 carrying thereon the circuit components 56 of the ballast circuit 4 including the AC/DC converter means 6, the DC/AC converter means 7, the arithmetic part 8, and the control part 9, the cover 54 for housing the circuit board 53, and the translucent globe 55 arranged so as to enclose the fluorescent lamp 51. This makes it possible to accomplish fluorescent lamp dimming when an incandescent lamp is replaced with a fluorescent lamp of the type described in the present embodiment. Since the operating apparatus of discharge lamp of the present embodiment is able to accomplish dimming similar to that in the incandescent lamp, so that even when an incandescent lamp is replaced by a fluorescent lamp of the present embodiment, the degree of incongruity that a user may feel can be reduced.

In the first embodiment, the commercial ac power supply 1 is 60 Hz/100V. Other power supplies of different frequency and voltage (for example, a power supply of 50 Hz/100V) can, of course, be used. Further, the DC/AC converter means 7 is a series inverter construction. However, the DC/AC converter means 7 may be implemented by other constructions (for example, a half bridge inverter construction). That is, any construction may be used as long as it is capable of converting a dc output voltage from the AC/DC converter means 6 to a high frequency ac voltage and of supplying electric power to the fluorescent lamp 3.

In the second embodiment, the shape of the fluorescent lamp 51 is not limited to a curved shape. The fluorescent lamp 51 can have any other shapes as long as it functions as a fluorescent lamp. Further, the base 52 is not limited to a base of the incandescent lamp E26 type. Any other base of different shape may be used. The description has been made in terms of compact self-ballasted fluorescent lamps with the globe 55. However, it is needless to say that the presence or absence of the globe 55 is irrelevant.

Further, in the first and second embodiments, phase-controlled ac voltage is fed through the phase controller means to the ballast circuit. However, it is needless to say that even when ac voltage is fed into the ballast circuit directly from the commercial ac power supply, the lamp will light normally.

In the first and second embodiments, from a half-cycle integrated value of the ac voltage which has undergone voltage division by the resistors in the arithmetic part 8, an approximate average value in one cycle is found. However, it will be sufficient that the output of the DC/AC converter means 7 is made variable according to an integrated value of the ac voltage based on a half cycle thereof. Therefore, employing either a technique of finding, without ac voltage division, an approximate average value in one cycle from a half-cycle integrated value of the ac voltage which is not voltage divided, or another of multiplying an approximate average value in one cycle found from a half-cycle integrated value of the ac voltage and a specific coefficient (e.g., 0.25), will produce no problem.

In accordance with the present invention, it is possible to adjustably control the brightness of a discharge lamp (a fluorescent lamp) by making the light output with respect to the conduction period of a phase-controlled ac voltage much similar to that in the incandescent lamp, thereby to accomplish fluorescent lamp dimming without causing a user to feel something incongruent.

What is claimed is:

1. An operating apparatus of discharge lamp comprising:

AC/DC converter means for converting an ac voltage into a dc voltage;

DC/AC converter means for converting a dc output voltage of said AC/DC converter means into a high frequency ac voltage;

a discharge lamp coupled to an output terminal of said DC/AC converter means; and controller means by which the output of said DC/AC converter means is made variable according to an integrated value of said ac voltage based on a half cycle thereof.

2. The operating apparatus of discharge lamp of claim 1, said controller means having:

an arithmetic part for performing arithmetic operations to calculate from said integrated value an approximate average value in one cycle; and a control part by which the output of said DC/AC converter means is made variable according to an output signal level of said arithmetic part.

3. The operating apparatus of discharge lamp of claim 1, said controller means further having:

characteristic detector means for detecting a lamp characteristic of said discharge lamp.

4. The operating apparatus of discharge lamp of claim 3, wherein said characteristic detector means detects at least one of lamp voltage, lamp current, lamp power, and light output as said lamp characteristic.

5. The operating apparatus of discharge lamp of claim 1, wherein said controller means has a function of causing the output frequency of said DC/AC converter means to vary.

6. The operating apparatus of discharge lamp of claim 1, wherein said operating apparatus of discharge lamp is a compact self-ballasted fluorescent lamp with a base in which a ballast circuit including at least said AC/DC converter means, said DC/AC converter means, and said controller means and said discharge lamp are integrally formed.

* * * * *

UNITED STATES PATENT AND TRADEMARK OFFICE

CERTIFICATE OF CORRECTION

PATENT NO. : 6,509,698 B1 
DATED : January 21, 2003
INVENTOR(S) : Satoshi Kominami et al.

It is certified that error appears in the above-identified patent and that said Letters Patent is hereby corrected as shown below:

Title page,
Item [56], References Cited, U.S. PATENT DOCUMENTS, delete "5,729,096" add -- 5,279,096 --.

Signed and Sealed this

Fifth Day of August, 2003

JAMES E. ROGAN
*Director of the United States Patent and Trademark Office*